United States Patent [19]

Marik

[11] 3,964,858

[45] June 22, 1976

[54] AUTOMATIC CANDLE-WICKING MACHINE

[76] Inventor: Norman J. Marik, Sibley Drive, Selmer, Tenn. 38375

[22] Filed: Sept. 30, 1974

[21] Appl. No.: 510,157

[52] U.S. Cl. ..... 431/288; 29/432; 264/249; 431/120; 425/517

[51] Int. Cl.[2] ..... F23D 3/16

[58] Field of Search ..... 431/120, 288; 425/517; 264/249; 29/432, 432.1; 83/208, 575, 580

[56] References Cited

UNITED STATES PATENTS

| | | | |
|---|---|---|---|
| 1,786,634 | 12/1930 | Sgritta | 435/517 X |
| 2,707,026 | 4/1955 | Hoern | 83/580 X |
| 3,583,853 | 6/1971 | Schramm | 431/291 |
| 3,596,042 | 7/1971 | Volk | 83/580 X |

FOREIGN PATENTS OR APPLICATIONS

| | | | |
|---|---|---|---|
| 206,229 | 7/1908 | Germany | 425/517 |

*Primary Examiner*—William F. O'Dea
*Assistant Examiner*—Harold Joyce
*Attorney, Agent, or Firm*—Oldham & Oldham Co.

[57] ABSTRACT

The invention relates to a candle-wicking machine which automatically operates to insert a candle wick into a candle after the candle has been formed to its desired shape. A plurality of candles can be wicked at the same time. Essentially, wicking material is cut to length, and then engaged near one end with a wicking rod that is forced down into the candle carrying the wicking material with it and depositing the wicking material into the candle on removal of the wicking rod. The essence of the invention lies in proper association of the wicking material with the wicking rod, cutting the wicking material to proper length, and the engagement of the wicking rod with the wicking material to force it into the candle.

7 Claims, 6 Drawing Figures

AUTOMATIC CANDLE-WICKING MACHINE

PRIOR ART

Heretofore it has been known that the primary way that candles are wicked is to deposit wicking material into a candle-forming mold and then pour the appropriate wax in hot form into the mold around the wick and allow the wax to harden to final form within the mold. In this way the wick is formed with the candle, and the wax adheres to and around the wicking material as it cools and solidifies. However, this method of placing wicks within molds is difficult and expensive because it normally must be done manually, and further it is often difficult to maintain the wick in the proper position within the mold as the wax is poured into place. There have been numerous attempts made to try to effect automatic wicking of candles, but they have basically been unsuccessful in achieving automatic positioning of the wicks into the candle after the candle is made, and further they have been cumbersome to operate and expensive to manufacture.

OBJECTS OF THE PRESENT INVENTION

The general object of the present invention is to avoid the aforesaid and other objections to the prior art practices by the provisions of an automatic candle-wicking machine which is highly reliable, inserts the wick into the candle after it has formed, and is relatively simple mechanically and relatively inexpensive to manufacture.

A further object of the invention is to provide an automatic candle-wicking machine which reliably cuts wicking material to proper length, and utilizes a wicking rod to engage the wicking material and force it down into the candle in the proper position, and to the proper depth.

A further object of the invention is to provide an automatic candle-wicking machine which consists of three steps in its operation, namely a feeding of wicking material, a cutting off of the wicking material to the proper length, and a wick depositing mechanism to deposit the cut-off length of the material into a candle in the proper position and to the proper depth.

The aforesaid objects of the invention and other objects which will become apparent as the description proceeds are achieved by providing an apparatus to effect wicking of candles which comprises a roll of candle wick material, means to measure and cut off a length of the wick material, a candle, and means to engage an end of the wick material and drive it into the candle on the central axis thereof to substantially the full length of the candle.

For a better understanding of the invention, reference should be made to the accompanying drawings wherein FIG. 1 is a front elevational view of the candle-wicking apparatus comprising a preferred embodiment of the invention;

Figure 1:
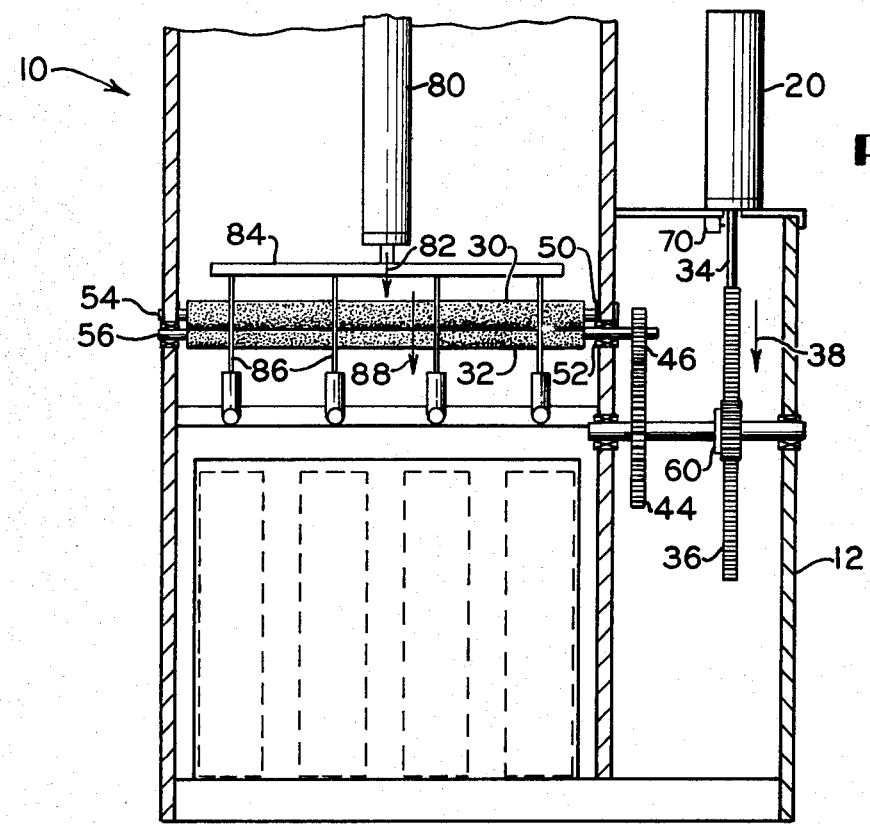

With particular reference to the preferred embodiment of the invention illustrated in the drawings, reference should now be made to the drawings wherein numeral 10 illustrates a candle-wicking machine generally, which comprises a basic frame 12 for supporting the candle-wicking mechanism of the invention.

Figure 2:
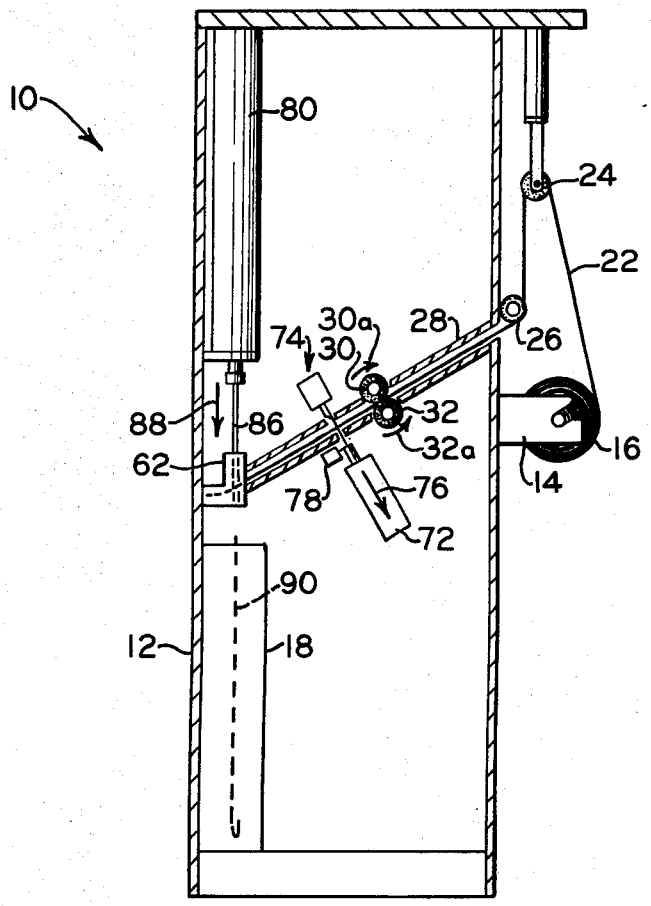
FIG. 2 is a side elevational view of the wicking machine of FIG. 1.

Specifically, supported by the frame 12 are a wicking material support arm 14 and a wicking roll 16 carried thereby. A plurality of candle supports illustrated by numeral 18, four in number, are supported near the base of frame 12 as seen in FIGS. 1 and 2.

An air cylinder 20 is likewise mounted to frame 12, and cylinder 20 provides for feed of the wicking material 22 from roll 16. Specifically, the wicking material 22 passes from roll 16 around a pair of idler rolls 24 and 26, as best seen in FIG. 2, and thence into a wicking tube 28. In the embodiment of the invention illustrated, there will be four wicking tubes and four strands of wicking material because this equipment is designed to wick four candles simultaneously. However, it is obvious that the principles of the invention could be applied to more or less structures operating simultaneously. In any event, the wicking material 22 passes down tube 28 and between the bite of a pair of rubber drive rollers 30 and 32. The drive rollers 30 and 32 rotate in the direction of arrows **30*a* and 32*a* respectively, so as to pull the wicking material 22 further down the tube 28 as the rollers 30 and 32** are rotatably driven.

The driving action of the rollers 30 and 32 is achieved by actuation of air cylinder 20 which, through its connecting rod 34, drives a rack 36 in the direction of arrow 38. The driving action of rack 36 rotates gear 40 mounted on shaft 42 which in turn drives gear 44. The gear 44 drives an idler gear 46 connected to shaft 48. Shaft 48 drives roller 32, which by friction drives roller 30. The rollers are mounted by shafts 54 and 56, which in turn are rotatably mounted by bearings 50 and 52.

Hence it should be understood then that the simple actuation of cylinder 20 will cause the movement of the feed rollers 30 and 32 a precise number of turns to draw a precise length of wicking material 22 through the tube 28. When the piston rod 34 returns to its initial position in cylinder 20, the shaft 42 is prevented from turning by a one-way clutch 60 connected and associated with the gear 40, as is conventional in one-way drives known by the art.

Figure 3:
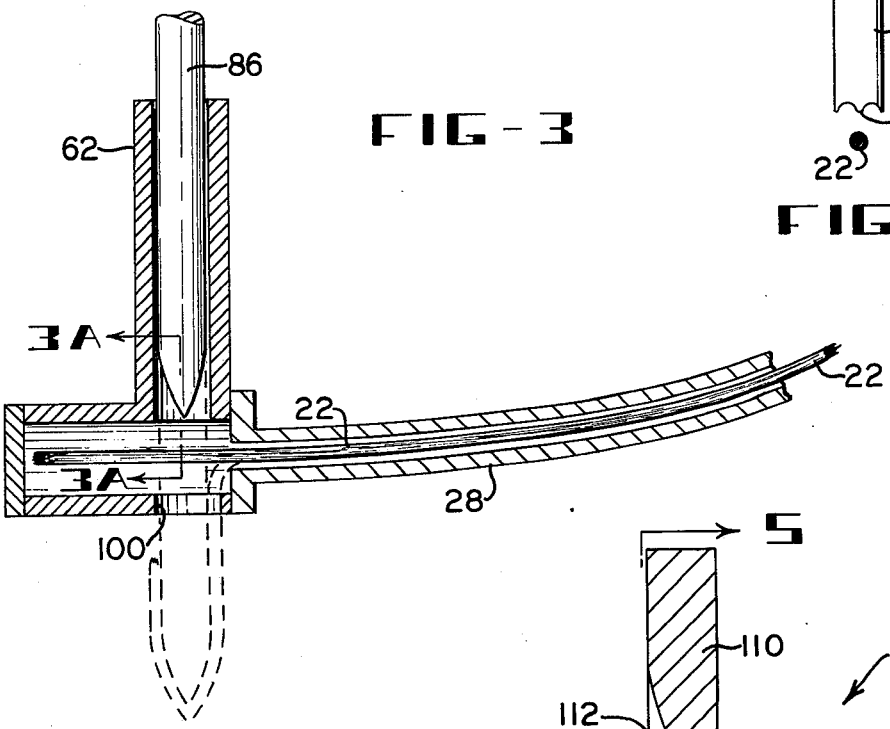
FIG. 3 is a cross-sectional, enlarged, broken-away view of the wicking rod - wicking material engaging mechanism.

The tube 28 extends down to and is mounted at the base of wicking tubes identified generally by the numeral 62 and the length of the rack 36 is such as to drive a length of wicking material 22 so that it just comes down to and fills into the wicking tube 62 in the position shown in the solid line indication of FIG. 3 of the drawings. When the rack 36 rises back to its initial position, it contacts a switch 70 which is of the one-way type so that it is only actuated when it is pushed such one way, and the actuation of switch 70 energizes a cylinder 72 which actuates a cutting mechanism indicated generally by numeral 74 and to be described in more detail hereinafter, to cut the wick material 22 off at the predetermined length.

The actuation of cylinder 72 is in the direction of arrow 76, and at the bottom of its stroke it actuates a one-way switch 78 which in turn energizes a piston 80 in the direction of arrow 82 which is connected through linkage mechanism 84 to a plurality of wicking rods 86 that are slidably received into the wicking tubes 62, as best seen in FIGS. 1 – 3 of the drawings. The downward movement of the wicking rods 86 in the direction of the arrow 88 causes the wicking rods to pick up the wick material 22 and move it initially down into the dotted line position shown in FIG. 3 of the drawings, and thence completely down into the candle to the dotted line position illustrated by numeral 90 in FIG. 2 of the drawings. The full downward stroke of piston 80 is of the proper length so as to insert a wick fully down into a respective candle the proper distance, and of course the length of the stroke and the length of the wicking rods is adjustable to compensate for different length wicks associated with different length candles.

Preferably the cylinders 20, 72, and 80 are pneumatically operated, and the machine is initially actuated by an operator depressing a switch causing the actuation of cylinder 20, but the actuation then of the remaining cylinders is automatic by virtue of electrical switches 70 and 78, as described above.

The particular construction of the wicking rod and wicking tube relationship with respect to the wicking material is best illustrated in FIG. 3 of the drawings, and it should be noted that the wicking rods slide in very close-fitting relationship with the wicking tubes in the upper portion thereof, but that the lower hole 100 is enlarged to allow the passage of the wicking material therethrough when the wicking rod engages it and forces it down through and into the respective candle.

Figure 3A:
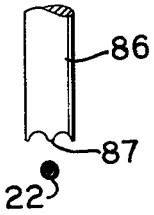
FIG. 3A is an enlarged, broken-away view of the wicking rod taken on line 3A/3A of FIG. 3.

I have found that the construction or configuration of the end of the wicking rods is relatively important to the invention, but any design shape to have a substantially pointed end to penetrate the wax portion of the candle without undue resistance, and to firmly hold the wick in the wrapped-around configuration shown in the dotted line portion of FIG. 3 so that the wick will move with the rod and without sliding off the end thereof, is necessary to achieve the objects of the invention. The pointed configuration to catch and hold the wicking material is shown in FIG. 3A, which shows that the center of the wicking rod tip is ground or formed to a point at 87. Any other pointed configuration that would pick up and grab the wicking material would meet the objects of the invention.

Figure 4:
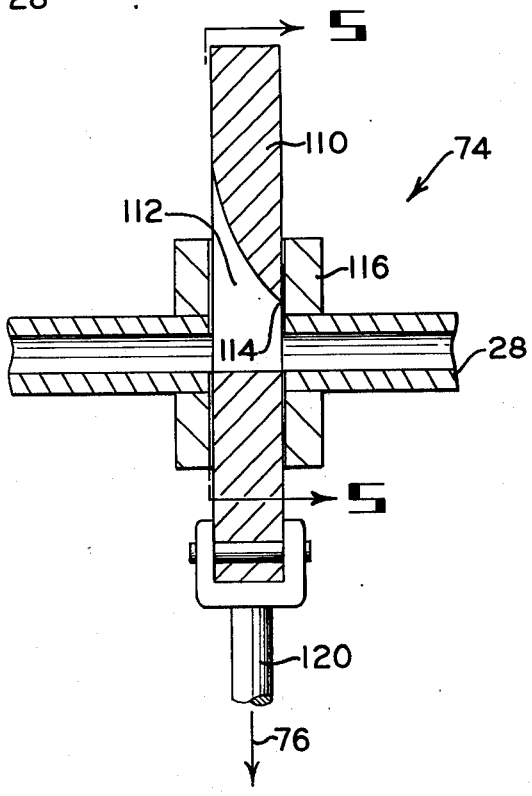
FIG. 4 is an enlarged, broken-away cross-sectional view of the cutting mechanism.

The cutting configuration of the mechanism 74 is best shown in FIG. 4 of the drawings, and this comprises a cutting blade 110 with a cutting hole 112 having a curved cutting edge 114 which engages the wicking material to effect a cutting action against the face of a cutting block 116. Note that the wicking tube 28 is recessed into the cutting block 116 so that a cutting edge is maintained between the cutting block 116 and the cutting edge 114 upon actuation of the connecting rod 120 in the direction indicated by arrow 76.

Figure 5:
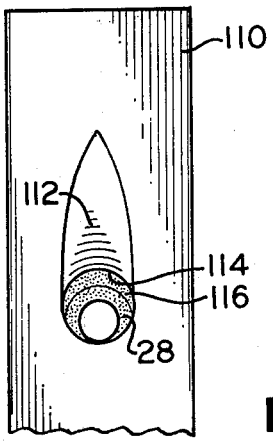
FIG. 5 is an enlarged, broken-away view of the cutting blade taken on line 5/5 of FIG. 4.

The actual configuration of the cutting hole 112 and the cutting edge 114 is best seen in FIG. 5 of the drawings.

It should be understood that with this mechanism there is virtually no chance of a hang-up of the wicking material 22 as it passes through the tube 28 before or after the cutting action because of the circular hole relationship of the cutting blades with respect to the cutting edge. A good, clean, precise cut on the wicking material is achieved, and the entry of the new wicking material upon actuation of cylinder 20 then ensures that a new length of material of proper configuration is presented for the next cutting action.

While in accordance with the patent statutes only a best known embodiment of the invention has been illustrated and described in detail, it is to be particularly understood that the invention is not limited thereto or thereby, but that the inventive scope is defined in the appended claims.

What is claimed is:

1. Apparatus to effect wicking of candles which comprises, a roll of candle wick, means to measure and cut off a length of wick, a candle, and an integral fixed wicking tube supported above the candle having one opening to receive the candle wick, and a second opening at an angle to the one opening, a wicking rod adapted to be received into the second opening, said second opening having an extended length to receive the wicking rod in close fitting sliding relation to serve to support and guide the wicking rod, and means to move the wicking rod to engage near the end of the candle wick and drive it into the candle on the central axis thereof to substantially the full length of the candle.

2. Apparatus according to claim 1 where the means to measure and cut off a length of wick comprises a rack and gear, means to drive the rack a predetermined distance, means connecting the gear to the candle wick to advance the wick upon rotation of the gear, and knife means to cut the candle wick at the point of advancement.

3. Apparatus according to claim 2 including one-way clutch means between the gear and the means connecting the gear whereby the candle wick can only be advanced.

4. Apparatus according to claim 3 which includes an elongated tube through which the candle wick is advanced, said knife means comprising a slide bar operatively associated with the tube and movable substantially perpendicularly with respect to the axis thereof, said bar having a hole therethrough normally aligned with the axis of the tube, a cutting edge on one side of the hole and means to move the bar with respect to the tube to move the cutting edge of the hole past the axis of the tube.

5. Apparatus according to claim 4 where the means to engage is a wicking rod adapted to engage the end of a cut section of wick, and means to move the wicking rod a predetermined distance in alignment with the central axis of the candle.

6. Apparatus according to claim 5 where the wicking rod has a substantially M-shaped tip with the center point of the M-shape being a sharp point that pierces into the candle wick to effect a secure engagement therewith upon axial movement of the wicking rod.

7. Apparatus according to claim 6 where the wicking rod is formed to a tapered, pointed tip defining one edge having the substantially M-shape therealong.

* * * * *